US005240411A

United States Patent [19]

Abalos

[11] Patent Number: 5,240,411

[45] Date of Patent: Aug. 31, 1993

[54] ATMOSPHERIC GAS BURNER ASSEMBLY

[75] Inventor: Martin Abalos, Pomona, Calif.

[73] Assignee: Mor-Flo Industries, Inc., Cleveland, Ohio

[21] Appl. No.: 833,106

[22] Filed: Feb. 10, 1992

[51] Int. Cl.[5] ..... F23D 14/14; F23D 14/62

[52] U.S. Cl. ..... 431/329; 431/354; 431/114; 126/92 AC

[58] Field of Search ..... 431/326, 328, 329, 354, 431/355, 7, 114; 126/92 AC

[56] References Cited

U.S. PATENT DOCUMENTS

| | | | |
|---|---|---|---|
| 810,968 | 1/1906 | McKnight | 431/355 X |
| 1,116,912 | 11/1914 | Parisen . | |
| 1,935,919 | 11/1933 | Ronstrom | 122/16 |
| 2,254,248 | 9/1941 | Stirlen | 126/43 |
| 2,368,356 | 1/1945 | Happe | 158/96 |
| 2,385,854 | 10/1945 | Wolfersperger | 158/99 |
| 2,799,288 | 7/1957 | Knight | 137/98 |
| 2,888,911 | 6/1959 | Thompson | 122/156 |
| 3,131,749 | 3/1964 | Davis, Sr. | 158/4 |
| 3,156,292 | 11/1964 | Ross | 158/114 |
| 3,199,572 | 8/1965 | Boulet | 158/116 |
| 3,204,683 | 9/1965 | Ruff et al. | 431/326 |
| 3,280,774 | 10/1966 | English | 110/162 |
| 3,291,187 | 12/1966 | Haensel | 431/329 |
| 3,324,924 | 6/1967 | Hailstone et al. | 158/99 |
| 3,445,175 | 5/1969 | Krieger | 431/328 |
| 3,601,320 | 8/1971 | DuPlessis | 239/542 |
| 3,759,230 | 9/1973 | Cooksley | 122/156 |
| 3,868,212 | 2/1975 | Lemaine | 431/328 |
| 3,907,210 | 9/1975 | Dow, Jr. et al. | 239/553.3 |
| 3,923,446 | 12/1975 | Budden et al. | 431/114 |
| 4,140,100 | 2/1979 | Ishihara | 126/92 B |
| 4,204,832 | 5/1980 | Miller | 431/20 |
| 4,257,355 | 3/1981 | Cook | 122/17 |
| 4,301,772 | 11/1981 | Eising | 122/17 |
| 4,303,042 | 12/1981 | Sumiyoshi | 122/17 |
| 4,336,820 | 6/1982 | Jorgensen et al. | 137/100 |
| 4,385,723 | 5/1983 | Sanborn et al. | 236/18 |
| 4,385,887 | 5/1983 | Yamamoto et al. | 431/90 |
| 4,397,296 | 8/1983 | Moore, Jr. et al. | 126/360 A |
| 4,445,464 | 5/1984 | Gerstmann et al. | 122/16 |
| 4,449,484 | 5/1984 | Sakamoto et al. | 122/13 R |
| 4,473,034 | 9/1984 | Raudabaugh et al. | 122/18 |
| 4,519,770 | 5/1985 | Kesselring et al. | 431/7 |
| 4,541,410 | 9/1985 | Jatana | 126/362 |
| 4,641,631 | 2/1987 | Jatana | 126/101 |
| 4,657,506 | 4/1987 | Ihlenfield et al. | 431/329 |
| 4,657,506 | 4/1987 | Ihlenfield et al. | 431/329 |
| 4,678,431 | 7/1987 | Widemann et al. | 431/328 |
| 4,766,883 | 8/1988 | Cameron et al. | 126/351 |
| 4,793,800 | 12/1988 | Vallet et al. | 431/328 |
| 4,872,833 | 10/1989 | Kramer | 431/354 |
| 4,924,816 | 5/1990 | Moore, Jr. et al. | 122/17 |
| 5,022,352 | 6/1991 | Osborne et al. | 126/17 |
| 5,085,579 | 2/1992 | Moore, Jr. et al. | 431/326 |

FOREIGN PATENT DOCUMENTS

| | | | |
|---|---|---|---|
| 1511969 | 2/1967 | France | 431/328 |
| 7525776 | 8/1975 | France . | |
| 53-24140 | 3/1978 | Japan . | |
| 371237 | 9/1963 | Switzerland | 431/329 |
| 434226 | 11/1974 | U.S.S.R. | 431/328 |
| 826673 | 1/1960 | United Kingdom | 431/329 |
| 1499213 | 1/1978 | United Kingdom | 431/354 |

*Primary Examiner*—Carl D. Price

*Attorney, Agent, or Firm*—Body, Vickers & Daniels

[57] ABSTRACT

An atmospheric gas burner assembly producing relatively low oxides of nitrogen ($NO_x$) emissions comprising a gas-air feed tube communicating with a burner chamber portion provided with an apertured inner burner distribution plate member having a multiplicity of relatively large size outlet apertures for distributing the gas-air mixture outwardly from the burner chamber portion, an intermediate burner port plate member overlying the apertured distribution plate member in spaced relation thereto and provided with a multiplicity of relatively small size burner port outlets for issuing outwardly therefrom small gas-air streams which combust to form a low temperature, low flame front profile over the outer surface of the burner port plate member, and an outer screen mantle member of woven stainless steel wire cloth of fine mesh overlying the burner port plate member is closely spaced relation thereto and positioned within the tip ends of the flame front issuing from the burner port plate member to become heated to an infrared radiant heat emitting condition. A turbulator member is positioned within the venturi tube to create turbulence of the fuel-air mixture passing therethrough to minimize resonance thereof during burner operation.

11 Claims, 5 Drawing Sheets

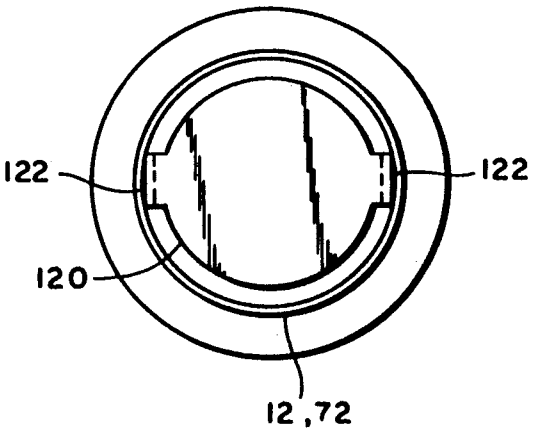
FIGURE 9
FIGURE 7
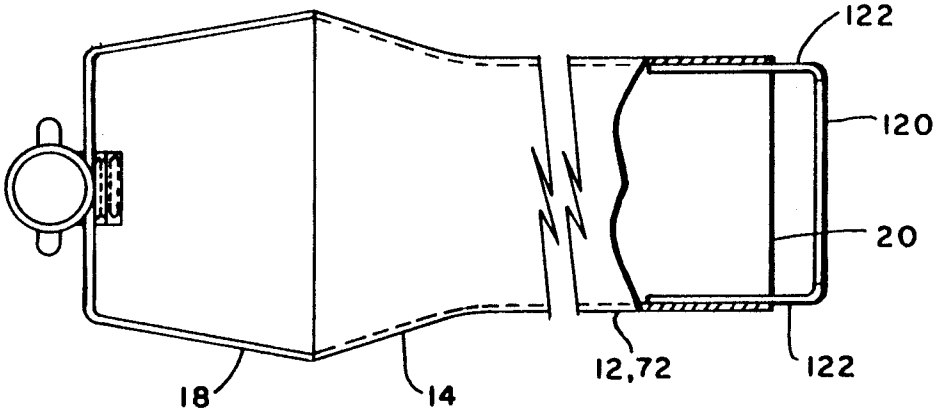
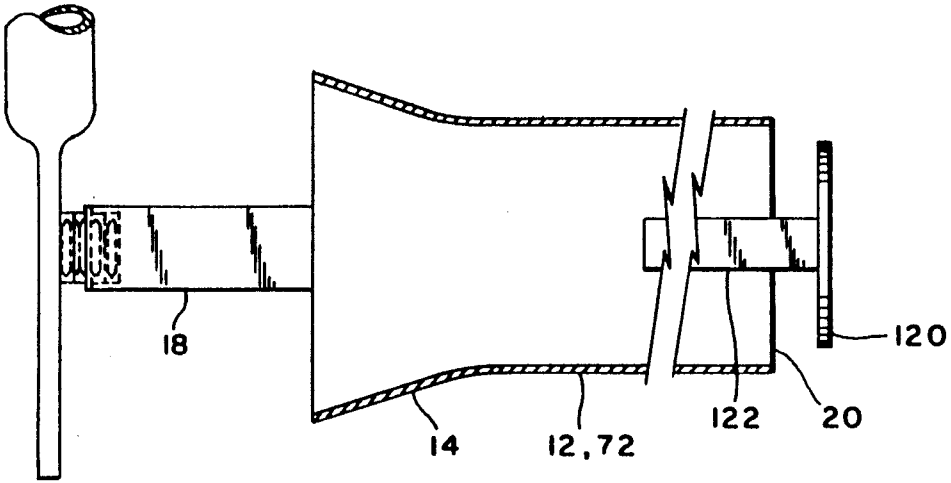
FIGURE 8

ATMOSPHERIC GAS BURNER ASSEMBLY

The present invention relates to atmospheric gas burner assemblies for water heaters and the like, and more particularly to gas burner assemblies characterized by reduced emission of oxides of nitrogen and reduced operating noise.

BACKGROUND OF THE INVENTION

Atmospheric gas burners such as are commonly employed in water heating apparatus such as, for example, water heaters produce combustion effluents including oxides of nitrogen ($NO_x$) which are a particularly troublesome source of air pollution. $NO_x$ contributes to the formation of photochemical oxidants, commonly known as smog. Hydrocarbons react with $NO_x$ in the presence of sunlight to form these oxidants, which can have severe irritating effects on the eyes and respiratory systems of human beings. Because of this, emissions of oxides of nitrogen ($NO_x$) from many sources including water heaters are subject regulations in certain areas of the country such as, for example, the Los Angeles, Calif., area. Consequently, continuous efforts are being made to reduce the $NO_x$ emission from atmospheric gas burners such as ordinarily used in water heating apparatus such as ordinary water heating tanks.

Another problem which has been present with such atmospheric gas burners employed in such water heating apparatus has been the production of excessive noise during the operation of such gas burners, which sometimes nears the level of noise produced by a fog horn. The reduction of the noise level produced by such gas burners therefore has been a subject of further continuing effort by manufacturers of water heaters.

BRIEF SUMMARY OF THE INVENTION

The present invention contemplates new and improved atmospheric gas burner assemblies for water heating apparatus which overcomes all of the above referred to problems and others and provides a gas burner assembly of simple construction and efficient in operation and which is characterized by reduced emission of oxides of nitrogen and reduced operating noise.

In accordance with one aspect of the invention, an atmospheric gas burner assembly is comprised of a burner chamber portion having a gaseous fuel-air mixture feed tube inlet opening, at least a portion of the wall of the burner chamber portion comprised of an inner fuel-air mixture distribution member of sheet metal provided throughout with a multiplicity of relatively large size spaced apart fuel-air mixture outlet holes, an intermediate burner port member of sheet metal overlying the distribution member in uniformly spaced relation thereto and provided with a multiplicity of closely spaced relatively small size burner ports, and an outer screen mantle member formed of woven wire cloth overlying the burner port member in uniformly closely spaced relation thereto and provided throughout with a multiplicity of fine screen mesh openings therein for passage therethrough of the flame front from the burner ports to heat the screen mantle member to a radiant heat emitting condition and to maintain a relatively low flame profile and cool the gas flames to maintain a relatively low flame temperature, thereby reducing $NO_x$ emission.

In accordance with another aspect of the invention, the holes in the distribution member of the gas burner assembly are uniformly spaced apart and each have an area of around 0.04 to 0.055 square inches and together comprise from about 35% to 45% of the surface area of the distribution member.

In accordance with a still further aspect of the invention, the burner ports in the intermediate burner port member are uniformly spaced apart and each have an area of around 0.007 square inches and together comprise about 33% of the surface area of the distribution member.

According to a still further aspect of the invention, the burner chamber portion of the gas burner assembly is of circular pan shape form having an open top and the outer screen mantle member, intermediate burner port member and inner distribution member are all of circular flat shape disposed one above the other in parallel relation and secured around their circular rim portions to the circular top edge portion of the pan shape burner chamber portion to form a top covering for the open top thereof.

In accordance with another aspect of the invention, the burner chamber portion of the gas burner assembly may be of cylindrical tubular shape and the outer screen mantle member, intermediate burner port member, and inner distribution member are all formed of cylindrical tubular shape and concentrically arranged within one another.

In accordance with a further aspect of the invention, the gas burner assembly comprises an open ended venturi tube having an open venturi inlet end for aspirating primary air thereinto for admixing with a pressurized gas fuel stream introduced into the tube inlet end, and a turbulator member is mounted within or adjacent the discharge end of the venturi tube for disrupting the resonance-producing straight through or wind tunnel like flow of the fuel-air mixture within and out the discharge end of the venturi tube and instead creating a turbulence of the fuel-air mixture as it flows through and out the discharge end of the tube which then serves to control noise and resonance during the burner operation and also to assure thorough intermixing of the fuel and air within the tube.

According to a still further aspect of the invention, the turbulator member may comprise either an elongated pin member mounted centrally within and extending axially within the venturi tube with a pointed end of the pin member facing upstream toward the open inlet end of the tube, or a U-shaped metal band member extending diametrically within the tube adjacent the open discharge end thereof or mounted outwardly adjacent and extending diametrically across the open discharge end of the tube, or it may be comprised of a metal disc mounted on the venturi tube in a position outwardly adjacent and extending concentrically across the open discharge end of the tube and of a diameter slightly smaller than the inside diameter of the open discharge end of the tube.

The principal object of the invention is to provide an atmospheric gas burner assembly for water heating apparatus which is characterized by low emission of oxides of nitrogen during burner operation.

Another object of the invention is to provide an atmospheric gas burner assembly which operates in a radiant state with a low flame profile and at a relatively low flame temperature.

Still another object of the invention is to provide an atmospheric gas burner assembly which operates with reduced noise and resonance.

Further objects and advantages of the invention will appear from the following detailed description of preferred species thereof and from the accompanying drawings.

BRIEF DESCRIPTION OF THE DRAWINGS

In the drawings:

FIG. 7 is a plan view, partly broken away, of the gas-air mixture feed tube shown in FIGS. 1–6, illustrating a modified form of turbulator member associated therewith;

FIG. 8 is a side elevation of the modified turbulator member shown in FIG. 7 and showing the feed tube in section;

FIG. 9 is an end view of the inner end of the feed tube shown in FIGS. 7 and 8;

Referring now to the drawings wherein the showings are for the purposes of illustrating preferred embodiments of the invention only and not for the purposes of limiting same, FIGS. 1–3 illustrate a pan or surface type of atmospheric gas burner assembly 10 according to the invention suitable for use in a common underfired type of water heater such as shown in U.S. Pat. No. 4,924,816, Moore et al. The burner assembly 10 comprises a horizontally extending gas-air feed or venturi tube 12 preferably formed of stainless steel and having a flared out, open outer or venturi inlet end 14 into which gas fuel is directed axially into the tube 12, from a gas supply feed pipe 16 having an outlet portion extending axially toward the flared open outer or venturi end 14 of the tube and supported thereon by a U-shaped manifold bracket or strap 18 of stainless steel secured to the outer end of the tube 12 as by welding. The fuel gas directed axially into the open venturi end 14 of the burner feed or venturi tube 12 from the feed pipe 16 aspirates primary combustion air from the surrounding atmosphere into the open outer end 14 of the burner feed tube 12 for mixing with the fuel gas stream from the gas supply feed pipe 16 to form a combustible gas-air mixture for combustion within the burner assembly 10.

Figure 1:
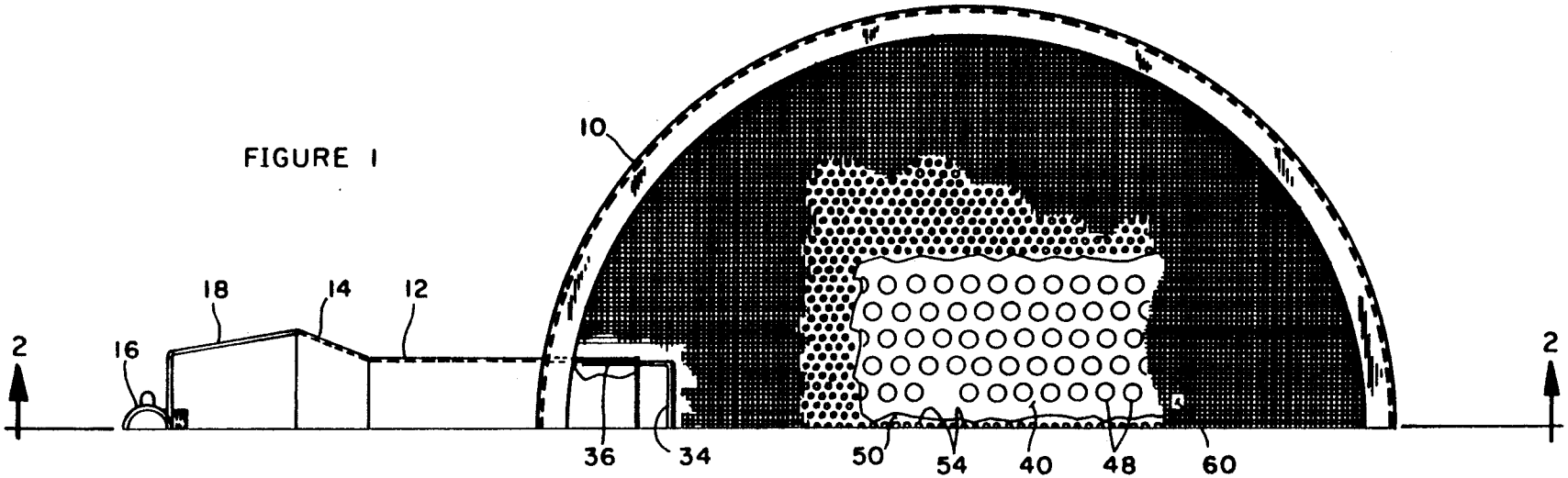
FIG. 1 is a plan view of a half portion of one embodiment of an atmospheric gas burner assembly according to the invention with portions thereof shown partly broken away.

The burner feed or venturi tube 12 extends a short distance into, and is mounted at its inner outlet or discharge end 20 in a substantially air tight manner, as by welding, within an opening 22 in an upstanding circular side wall 24 of an upwardly opening shallow pan-shaped burner chamber portion 26 preferably formed of stainless steel and having a bottom wall 28 and providing an upwardly opening burner chamber 30.

In accordance with the invention, a turbulator member in the form of a U-shaped stainless steel baffle or band member 34 is mounted opposite the open inner or discharge end 20 of the gas-air mixture feed or venturi tube 12, in a position extending diametrically across the open inner end 20 of the tube 12, to disrupt or breakup the continuous straight line or tunnel like flow of the gas-air mixture within and out of the tube 12, thereby creating turbulence of the gas-air mixture which acts to reduce the noise and resonance otherwise produced by such tunnel-like flow of the gas-air mixture within and out from the feed tube 12. The turbulence of the gas-air mixture created by the turbulator member 34 also serves to assure thorough intermixing of the gas and primary air stream flowing through the feed tube 12 to thereby provide efficient subsequent combustion thereof in the burner 10. The baffle or band member 34 is suitably supported in position on the feed tube 12 as by means of the strap shaped end leg portions 36 welded to and extending outwardly from the open inner end 20 of the feed tube 12.

The gaseous fuel-air mixture introduced from the feed tube 12 into the chamber 30 of the circular burner chamber portion 26 of the burner 10 flows upwardly from and out of the chamber 30 through a horizontally disposed, circular, perforated, flat inner or top distribution plate member 40 of stainless steel sheet which is mounted on, and forms the top wall covering the top opening of the burner chamber portion 26 at a level above the feed tube 12. To this end, the inner distribution member 40 is provided with an upstanding circular peripheral side wall portion 42 terminating in an outwardly projecting annular lip or flange 44 which is clinched within an outwardly projecting, folded over, annular rim clamp portion 46 which extends around the top periphery of the circular side wall portion 24 of the burner chamber portion 26 to mount the distribution plate member 40 in place thereon.

The distribution plate member 40 is provided throughout with a multiplicity of relatively large size apertures or holes 48 uniformly spaced apart therein for discharging the gaseous fuel air mixture upwardly therethrough from the burner chamber 30 in a more or less uniformly distributed manner across the flat upper surface of the distribution plate member 40. The apertures or holes 48 preferably are of uniform size each having an area of around 0.045 to 0.055 square inches and together comprise from about 35% to 45% of the total flat surface area of the inner distribution plate member 40. As shown, the apertures or holes 48 preferably are of circular shape having a diameter of around ¼ inch.

Overlying the inner distribution plate member 40 and extending horizontally in spaced parallel relation thereto is an apertured, circular, flat intermediate burner port plate member 50 preferably made of stainless steel sheet and also covering the top opening of the burner chamber portion 26. Like the distribution plate member 40, the burner port plate member 50 is also mounted in place on the side wall portion 24 of the burner chamber portion 26, being provided for such purpose with an upwardly offset, peripheral top lip portion 52 which is also clinched within the annular rim clamp 46 of the burner chamber portion 26. In practice, the burner port plate member 50 is spaced above the burner distribution plate member 40 a distance $d_2$ of around ½ inch or so.

The intermediate burner port plate member 50 is provided throughout with a multiplicity of relatively small size burner ports or apertures 54 uniformly spaced apart therein for passage upwardly therethrough of the gaseous fuel-air mixture discharged from the burner distribution plate member 40 to form small jet streams thereof issuing from the top surface of the burner port plate member 50 which are ignited and combust as they exit the burner ports 54, during the operation of the burner assembly 10, to produce a multiplicity of small gas flames rising from the entire top surface of the burner port plate member 50. The ports or apertures 54 in the burner port plate member 50 are of uniform size each having an area of around 0.007 square inches and together comprise about 33% of the total flat surface area of the burner port plate member 50. In practice, the burner ports or apertures 54 are of circular shape having a diameter of around 3/32 inches.

In accordance with the invention, a flat outer screen mantle member 60 of woven stainless steel wire cloth of fine mesh is disposed horizontally in spaced parallel overlying relation to the burner port plate member 50 to lie approximately within the upper tip ends or flame front of the gas flames issuing from the burner port openings 54 during burner operation. The screen mantle member 60 acts to maintain a relatively low flame profile and cools the gas flames to maintain a relatively low flame temperature, thereby reducing the emission of oxides of nitrogen ($NO_x$) from the burner assembly 10. Because it is disposed within the tip ends or flame front of the gas flames issuing from the burner ports 54 in the burner port plate member 50, the screen mantle member 60 attains a glowing condition in which it radiates away the infrared heat absorbed by it, thereby reducing the $NO_x$ emissions from the burner assembly 10. To operate in the above described manner, the screen mantle member 60 is positioned in closely spaced relation to the top surface of the burner port plate member 50, in practice being spaced a distance $d_1$ of around 3/16 to ¼ inch or so from the burner port plate member.

As stated above, the flat screen mantle member 60 is made of relatively fine mesh stainless steel wire cloth and it is mounted in place on the burner chamber portion 26, in completely overlying relation to the burner port plate member 60, by having its circular peripheral rim portion clamped in the annular rim clamp 46 formed at the top end of the upstanding side wall 24 of the burner chamber portion 26.

Figure 4:
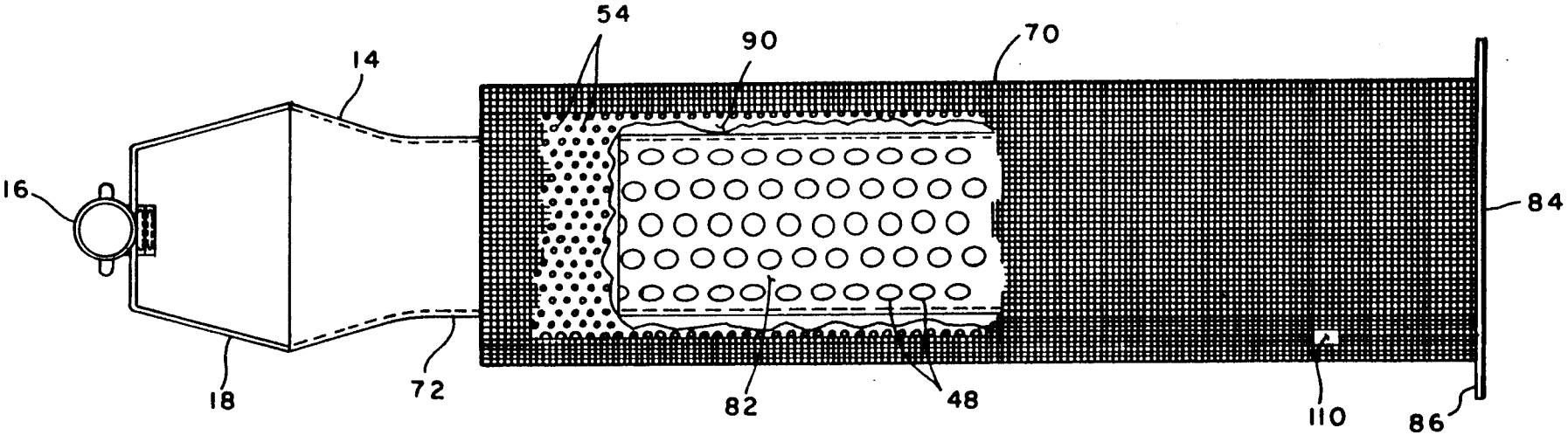
FIG. 4 is a plan view of another embodiment of an atmospheric gas burner assembly according to the invention with portions thereof shown partly broken away.
Figure 5:
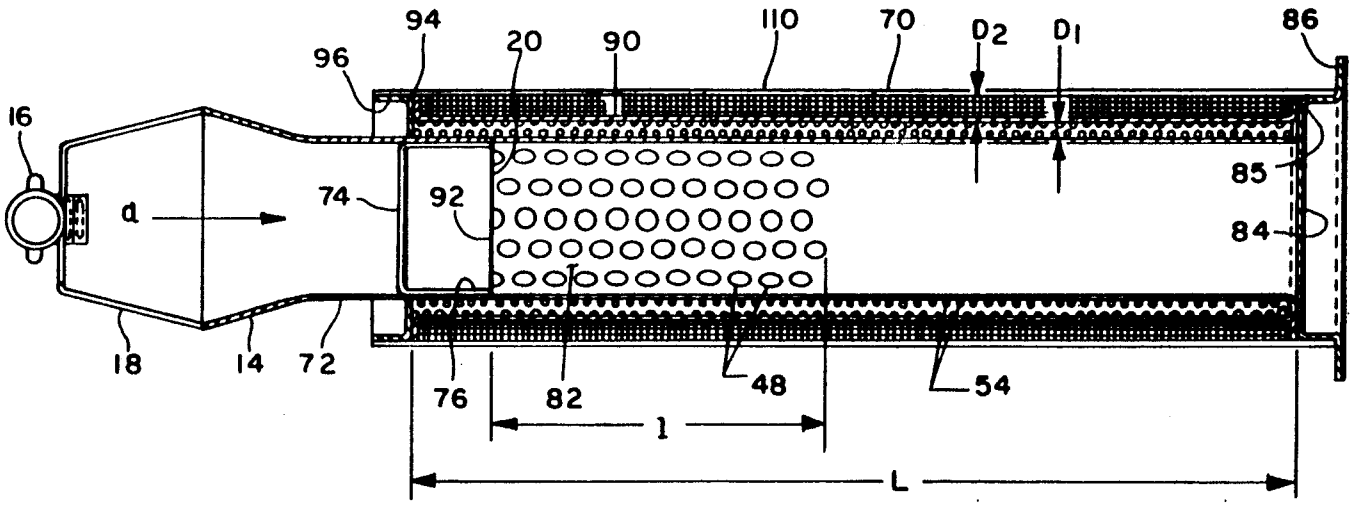
FIG. 5 is a longitudinal axial section of the burner assembly shown in FIG. 4.
Figure 6:
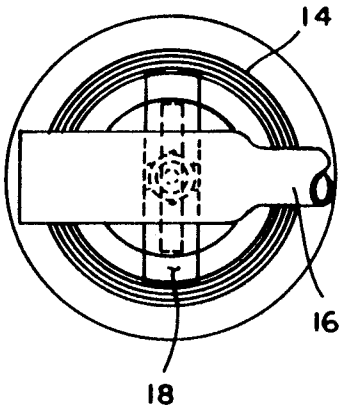
FIG. 6 is an end view of the gas-air inlet end of the feed tube of the gas burner assembly shown in FIGS. 4 and 5.

FIGS. 4–6 illustrate an alternative form of atmospheric gas burner assembly 70 according to the invention which is suitable for use in so-called submerged burner chamber type water heaters, such as marketed by applicant's assignee under the trade name Polaris water heaters and as shown and described in U.S. Pat. No. 4,397,296, Moore et al, in which the gas burner is contained within a combustion chamber which is completely submerged in the water reservoir in the water heater tank. Gas burner assembly 70 comprises a horizontally extending gas-air feed or venturi tube 72 preferably formed of stainless steel and having a flared out open outer or venturi inlet end 14, the same as in the case of the previously described gas burner assembly 10, into which open outer or inlet end 14 gas fuel is directed axially thereinto from a fuel gas supply feed pipe 16 extending axially toward the flared open outer or inlet end 14 of the tube 16. As before, the fuel feed pipe 16 is supported in position on the flared inlet end 14 of the feed or venturi tube 72 by a U-shaped manifold bracket or strap 18 of stainless steel secured to the outer end of the tube 72 as by welding. Primary combustion air from the surrounding atmosphere is aspirated into the open inlet end 14 of the feed tube 72, by the fuel gas directed axially thereinto from the fuel feed pipe 16, for mixing therewith to form a combustible gas-air mixture for combustion within the burner assembly 70.

Figure 3:
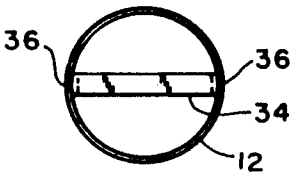
FIG. 3 is an end view taken on the line CC of FIG. 2, of the gas-air outlet end of the feed tube of the gas burner assembly shown in FIGS. 1 and 2.
Figure 2:
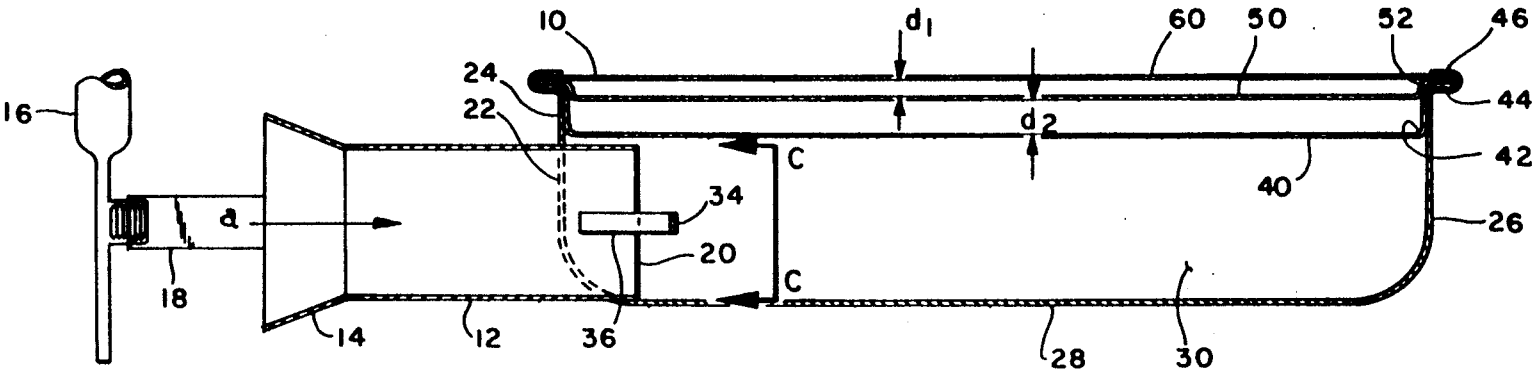
FIG. 2 is a vertical section on the line 2—2 of FIG. 1.

As in the case of the first form of the invention shown in FIGS. 1–3, the feed or venturi tube 72 is provided internally thereof with a turbulator member 74 for creating turbulence of the gas-air mixture flowing through the tube 72 during burner operation which acts to reduce the noise and resonance which would be otherwise produced by the tunnel-like flow of the gas-air mixture within the tube 72, as well as to assure the thorough admixing of the fuel gas and air. The particular turbulator member 74 shown in FIG. 5 is similar to the turbulator 34 of FIGS. 1–3 in that it comprises a U-shaped stainless steel band member which is mounted within the feed tube 72 adjacent the open inner or discharge end 20 thereof in a position extending diametrically across the tube. As before, the turbulator 74 is supported in position within the feed tube 12 by means of the strap shaped end leg portions 76 thereof which are welded to the inner wall of the feed tube.

At its cylindrical tubular inner end, the burner feed or venturi tube 72 is provided with an apertured, cylindrical burner chamber portion or cylinder 82 of stainless steel sheet constituting an inner extension of the feed tube 72 and serving as an inner tubular distribution plate member for discharging the gaseous fuel-air mixture flowing thereinto from the feed or venturi tube 72 radially outward therefrom through a multiplicity of relatively large size apertures 48 the same as in the case of the burner distribution plate member 40 in FIGS. 1–3, and in a more or less uniformly distributed manner within and around the cylindrical outer surface of the tubular distribution plate member or burner chamber portion 82. The tubular burner chamber portion or inner distribution plate member 82 may be formed as an integral inner extension of the gaseous fuel-air mixture feed tube 72 or it may be formed separately therefrom and welded thereto in end-to-end axially aligned relation therewith. In the particular form of the invention illustrated in FIGS. 4–6, the apertured burner chamber portion or cylinder 82 has a total length of around 7½ to 7¾ inches or so and, as shown, is provided with the apertures 48 throughout only a portion 1 of its length, amounting to around half or less its total length, starting from its upstream end 92. The burner chamber cylinder or inner distribution plate member 82 is closed at its innermost end by a circular inner end closure wall element 84 of stainless steel welded to its inner end to close off the inner chamber thereof. The end closure wall element 84 is formed with a short outwardly turned portion 85 terminating in a peripheral annular flange 86 protruding a short distance radially outward beyond the cylindrical portion 85 for a purpose described hereinafter.

As in the case of the inner distribution plate member 40 in FIGS. 1–3, the apertures 48 in the tubular distribution plate member 82 are uniformly spaced apart therein for discharging radially outward therethrough the gaseous fuel-air mixture from the inner chamber of the tubular distribution plate member 82 in a more or less uniformly distributed manner across and around the cylindrical outer surface thereof. As in FIGS. 1-3, the apertures 48 in the tubular distribution plate member 82 preferably are of uniform size each having an area of around 0.045 to 0.055 square inches and together comprise from about 35% to 45% of the total outer surface area of the tubular inner distribution plate member 82. As shown and as previously described, the apertures 48 preferably are of circular shape having a diameter of around ¼ inch.

Overlying the cylindrical inner tubular distribution plate member or cylinder 82 and extending horizontally therearound in radially outward spaced concentric relation thereto is an apertured, cylindrical, intermediate burner port plate member 90 preferably made of stainless steel sheet. In the particular case illustrated, the tubular burner port plate member or cylinder 90 has a total axial length L of around 8½ inches or so, and it extends axially of the burner from a point upstream a distance of around 0.8 to 1 inch or so from the upstream end 92 of the apertured tubular distribution plate member or burner chamber portion 82 and axially inward of the burner to the inner end of the tubular distribution plate member or burner chamber portion 82.

The tubular burner port plate member 90 is supported in position concentrically surrounding the tubular feed pipe 72 and tubular inner distribution plate member 82 and closed off at its inner end by engagement of its inner end with and welding to the end closure wall element 84 of the apertured burner chamber portion or distribution plate member 82, and by welding its outer end to an outer closure collar 94 mounted air-tightly on the fuel-air mixture feed pipe 72 as by welding it thereto and provided around its outer periphery with an outwardly turned cylindrical flange 96. In practice, the tubular burner port plate member 90 is of a diameter to radially space it concentrically outward from the apertured tubular burner chamber portion or distribution plate member 82 a radial distance $D_1$ of around ¼ to ⅜ inches.

The tubular burner port plate member or cylinder 90 is provided, throughout the full length L thereof extending between the outer closure collar 94 and the end closure wall element 84 and enclosing the apertured burner chamber cylinder 82, with a multiplicity of relatively small size burner ports or apertures 54 the same as the burner ports 54 in the burner distribution plate member 50 of FIGS. 1-3 and uniformly spaced apart in the tubular burner port plate member 90 for passage radially outward therethrough of the gaseous fuel-air mixture discharged from the apertured burner chamber portion or distribution plate member 82 to form small jet streams thereof issuing from the cylindrical outer surface of the tubular burner port plate member 90 which are ignited and combust as they exit the burner ports 54, during the operation of the burner assembly 70, to produce a multiplicity of small gas flames issuing radially outward from the entire outer surface of the apertured portion of the tubular burner port plate member 90. Like the burner ports 54 in FIGS. 1-3, the burner ports 54 in the burner port plate member 82 are of uniform size each having an area of around 0.007 square inches and together comprise about 33% of the total cylindrical surface area of the apertured portion of the tubular intermediate burner port plate member that surrounds the feed tube 72 and the apertured tubular burner chamber portion or distribution plate member 82. Also like the burner ports 54 in FIGS. 1-3, the burner ports 54 in FIGS. 4-6 preferably are of circular shape having a diameter of around 3/32 inches.

Overlying or surrounding the full length L of the tubular burner port plate member 90 and extending horizontally therearound in radially outward spaced concentric relation thereto is an outer cylindrical screen mantle member or cylinder 110 of woven stainless steel wire cloth of fine mesh corresponding to the screen mantle member 60 of FIGS. 1-3 and functioning in the same manner as that of member 60. For this purpose, the tubular screen mantle member or cylinder 110 is of a diameter to radially space it concentrically outward from the cylindrical tubular burner port plate member 90 a radial distance $D_2$, typically around 3/16 inches or so, such as to lie approximately within the outer tip ends or flame front of the gas flames issuing from the burner port openings 54 during burner operation. The so positioned screen mantle member 110 thus acts in the same manner as the screen mantle member 60 of FIGS. 1-3 to maintain a relatively low flame profile and cool the gas flames to maintain a relatively low flame temperature, thereby minimizing the emission of oxides of nitrogen ($NO_x$) from the burner assembly 70. The positioning of the screen mantle member 110 so as to lie within the tip ends or flame front of the gas flames issuing from the burner ports 54 in the tubular burner port plate member 90 also causes the tubular screen mantle member 110 to attain a glowing condition in which it radiates away the infrared heat absorbed by it, thereby further reducing the $NO_x$ emissions from the burner assembly 70. As shown, the tubular screen mantle member or cylinder 110 is mounted in its position surrounding and concentrically radially spaced outwardly from the tubular burner port plate member 90 by engaging its opposite ends around and welding them to the cylindrical flanges 96 and 85 on the outer closure collar 94 and the inner end closure wall element 84, respectively.

In developing the cylindrical burner assembly 70 of FIGS. 4-6, it was found that when the apertures 48 in the distribution plate member or cylinder 82 extended throughout the full length thereof and thus to the inner ends of the burner port plate member or cylinder 90 and the screen mantle member or cylinder 110, only the far or inner end portion of the screen mantle member or cylinder would become red hot while the outer end portion thereof would remain relatively cool. By forming the burner assembly 70 so that the apertures 48 in the burner distribution plate cylinder 82 extend axially thereinto, starting from its upstream end 92, a distance of only around half or less its axial length L, the screen mantle cylinder advantageously becomes more or less uniformly heated to a red hot condition over substantially its entire axial extent.

FIGS. 7-9 illustrate a modified form of turbulator 120 which can be employed in either of the burner assemblies 10 or 70 of FIGS. 1-6. As shown, the modified turbulator 120 is in the form of a disc-shaped stainless steel baffle member mounted opposite and adjacent the open inner or discharge end 20 of the gas-air mixture feed or venturi tube 12 or 72, in a position concentric with and extending transversely across the open inner end 20 of the tube 12 or 72. The baffle or disc member 120 is supported on the feed tube 12 or 72 by means of strap-shaped end leg portions 122 extending diametrically and in parallel relation from the disc member 120 into the open inner end 20 of the feed tube 12 or 72 and welded thereto.

Figure 10:
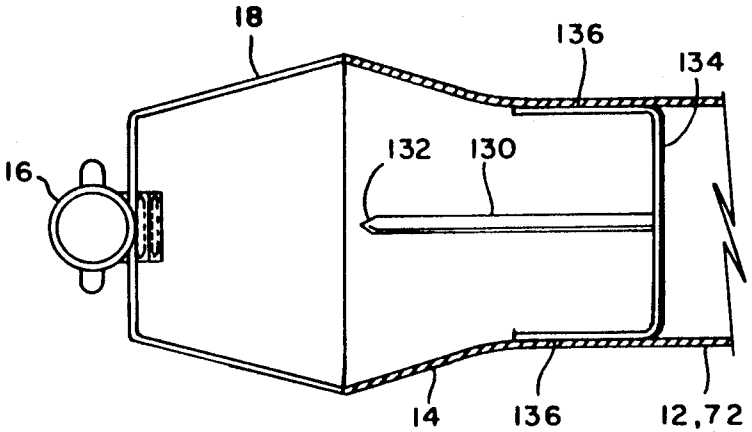
FIG. 10 is an axial sectional view of the outer end portion of the gas-air mixture feed tube shown in FIGS. 1–6, illustrating another modified form of turbulator member associated therewith.
Figure 11:
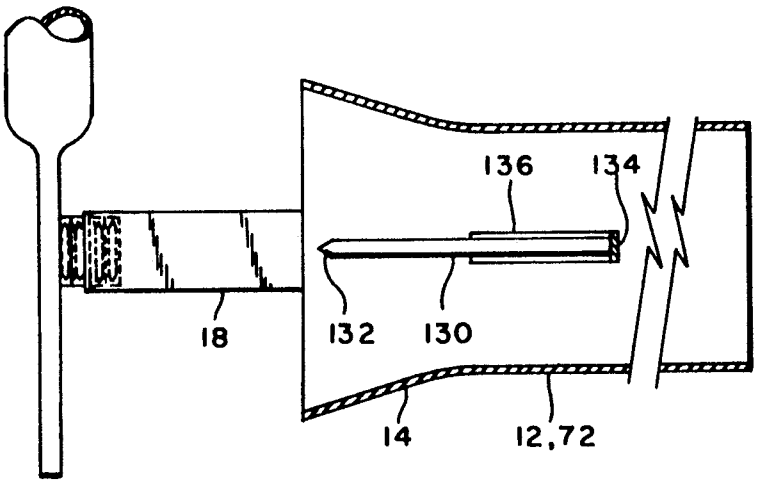
FIG. 11 is another axial sectional view of the feed tube shown in FIG. 10, taken at a right angle thereto and showing the modified turbulator member thereof in elevation; and, FIG. 12 is an end view of the inner end of the feed tube shown in FIGS. 10 and 11.
Figure 12:
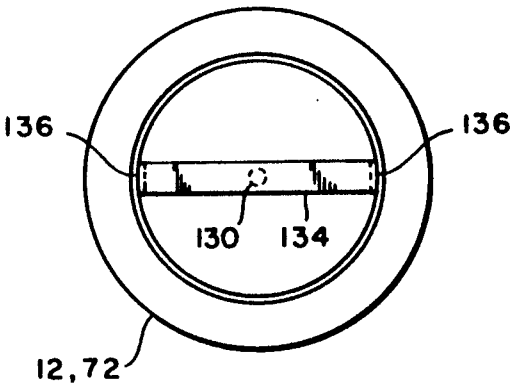

FIGS. 10–12 illustrate another modified form of turbulator 130 which can be employed in either of the burner assemblies 10 or 70. As shown, the modified turbulator 130 comprises an elongated stainless steel pin member extending axially within the feed tube 12 or 72, with a pointed end 132 thereof facing outwardly or upstream toward the open outer or inlet end 14 of the tube, and mounted in position within the flared outer end portion 14 of the feed tube 12 or 72 as by means of a U-shaped stainless steel band or bracket member 134 to which the pin member 130 is welded and the legs 136 of which are welded to the inner wall of the feed tube 12 or 72.

Having thus described the invention, it is claimed:

1. An atmospheric gas burner assembly adapted for use in a domestic water heater comprising a venturi tube having an open venturi inlet end for aspirating primary air thereinto and in admixture with a pressurized gas fuel stream introduced axially into said tube inlet end, said venturi tube having an open outlet end communicating in air tight manner with a burner chamber portion of a gas-air burner unit, and a turbulator member comprising a metal band disposed transversely of said venturi tube adjacent said outlet end thereof and extending diametrically thereacross and an elongated fixed non-rotating cylindrical pointed pin member located centrally of said band and extending axially within said venturi tube with its pointed end facing upstream toward the open inlet end thereof for creating a turbulence of the gas-air mixture within and at the outlet end of said tube to minimize noise during burner operation.

2. An atmospheric gas burner assembly adapted for use in a domestic water heater comprising a burner chamber portion having a gaseous fuel-air mixture feed tube inlet opening, at least a portion of the wall of said burner chamber portion comprised of an inner fuel-air mixture distribution plate member of sheet metal provided throughout with a multiplicity of relatively large size spaced apart holes for passage of said fuel-air mixture therethrough and out from said chamber portion, an intermediate burner port plate member of sheet metal overlying the said distribution plate member uniformly spaced about one-quarter to one-half inch from said distribution plate member and provided with a multiplicity of closely spaced relatively small size burner port, and an outer screen mantle member formed of woven wire cloth overlying the said burner port plate member uniformly spaced about three-sixteenths to one-quarter inch from said burner port plate member and provided throughout with a multiplicity of fine screen mesh openings therein for passage therethrough of the flame front to create a uniform radiant heat emitting condition.

3. An atmospheric gas burner assembly as set forth in claim 1, wherein the said holes in said distribution plate member are uniformly spaced apart and each have an area of around 0.05 square inches and together comprise from about 35% to 45% of the surface area of said distribution plate member; the said burner ports in said intermediate burner port plate member are uniformly spaced apart and each have an area of around 0.007 square inches and together comprise about 33% of the surface area of said burner port plate member.

4. An atmospheric gas burner assembly as set forth in claim 2, wherein the said burner chamber portion is of circular shallow pan shape form having a top opening and the said outer screen mantle member, intermediate burner port plate member, and inner distribution plate member are all of circular flat shape disposed one above the other in parallel relation and secured around their circular rim portions to the circular top edge portion of said pan shape burner chamber portion to form a top covering for the said top opening thereof.

5. An atmospheric gas burner assembly as set forth in claim 1, wherein the said burner chamber portion is of cylindrical shape and the said outer screen mantle member, intermediate burner port plate member, and inner distribution plate member are all formed of cylindrical shape and concentrically arranged within one another.

6. An atmospheric gas burner assembly as set forth in claim 2, further comprising an open-end venturi tube having an open venturi inlet end for aspirating primary air thereinto and in admixture with a pressurized gas fuel stream introduced axially into said tube inlet end, a turbulator member mounted in the flow stream of said fuel-air mixture through and out of said tube, for creating a turbulence of the said fuel-air mixture within and at the outlet end of said tube to minimize resonance thereof during burner operation, the said open outlet end of said tube communicating with said burner chamber portion of said burner assembly.

7. An atmospheric gas burner assembly as set forth in claim 6, wherein the said turbulator member comprises a stationary, non-rotating elongated pointed pin member located centrally of and extending axially within the said venturi tube with its pointed end facing upstream toward the open inlet end thereof.

8. An atmospheric gas burner assembly adapted for use in a domestic water heater comprising a feed tube having an open venturi inlet end for aspirating primary air thereinto and admixing it in said tube with a pressurized gas fuel stream introduced into said tube inlet end, said tube having an extended cylindrical inner tube end portion closed off at is inner end by an inner end closure member to form a tubular burner chamber portion, the cylindrical wall of said tubular burner chamber portion constituting a distribution plate member provided with a multiplicity of relatively large size spaced apart holes for passage of said fuel-air mixture therethrough, a cylindrical intermediate burner port plate member of sheet metal concentrically surrounding said tubular burner chamber portion spaced approximately one-quarter to three-eighths inch therefrom and supported in place therefrom by the said inner end closure wall element and by an outer closure collar mounted air-tightly on said tube, said cylindrical burner port plate member being provided, throughout the portion thereof overlying the said burner chamber portion of said tube, with a multiplicity of closely spaced relatively small size burner ports, and a cylindrical outer screen mantle member formed of woven wire cloth concentrically surrounding the said cylindrical burner port plate member spaced approximately three-eighths inch therefrom and supported in place at is opposite ends by the said outer closure collar and by the said inner end closure wall element, said outer screen mantle member being provided throughout with a multiplicity of fine screen mesh openings therein adapted to create a uniform radiant heat emitting condition.

9. An atmospheric gas burner assembly as set forth in claim 8, wherein a turbulator member is mounted in the flow stream of said fuel-air mixture through and out of said feed tube for minimizing resonance thereof during burner operation; said turbulator member comprising a metal band disposed transversely of said feed tube adjacent the open outlet end thereof and extending diametrically thereacross, said band being mounted on the wall of said feed tube and an elongated stationary cylindrical pin member located centrally of said band and extending axially within the said feed tube toward the open inlet end thereof.

10. An atmospheric gas burner assembly as set forth in claim 8, wherein the said cylindrical distribution plate member, said cylindrical burner port plate member, and said cylindrical screen mantle member extend inwardly having a given length and have approximately coterminous inner ends, and the said fuel-air passage holes in said distribution plate member are provided throughout only a portion of its length amounting to around half or less its total length starting from its upstream end.

11. An atmospheric gas burner assembly as set forth in claim 10, wherein the upstream end of said cylindrical distribution plate member is located from about 0.08 to 1.0 inch downstream from the outer end of said cylindrical burner port plate member.

* * * * *

UNITED STATES PATENT AND TRADEMARK OFFICE

CERTIFICATE OF CORRECTION

PATENT NO. : 5,240,411
DATED : August 31, 1993
INVENTOR(S) : Martin Abalos

It is certified that error appears in the above-indentified patent and that said Letters Patent is hereby corrected as shown below:

In Column 10, Line 39, delete "is" and substitute --its--.

In Column 10, Line 59, delete "is" and substitute --its--.

Signed and Sealed this

Third Day of May, 1994

Bruce Lehman

*Attest:*

BRUCE LEHMAN

*Attesting Officer*

*Commissioner of Patents and Trademarks*